US006533544B1

(12) United States Patent
Tiemann et al.

(10) Patent No.: US 6,533,544 B1
(45) Date of Patent: Mar. 18, 2003

(54) TURBINE BLADE

(75) Inventors: Peter Tiemann, Witten (DE); Ariel Jacala, Yorktown, VA (US)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 09/622,596

(22) PCT Filed: Apr. 14, 1999

(86) PCT No.: PCT/DE99/01109

§ 371 (c)(1),
(2), (4) Date: Sep. 12, 2001

(87) PCT Pub. No.: WO99/54597

PCT Pub. Date: Oct. 28, 1999

(30) Foreign Application Priority Data

Apr. 21, 1998 (DE) ..... 198 17 820

(51) Int. Cl.[7] ..... F01D 9/00
(52) U.S. Cl. ..... 415/191; 415/208.2; 415/211.2
(58) Field of Search ..... 415/115, 191, 415/208.2, 211.2; 416/248

(56) References Cited

U.S. PATENT DOCUMENTS

| | | | | |
|---|---|---|---|---|
| 2,500,745 A | | 3/1950 | Bloomberg | |
| 3,807,892 A | | 4/1974 | Frei et al. | |
| 4,283,822 A | * | 8/1981 | Muth et al. | 29/156.8 |
| 4,987,736 A | | 1/1991 | Ciokajlo et al. | |
| 5,076,049 A | | 12/1991 | Von Benken et al. | |
| 5,249,418 A | | 10/1993 | Finn | |
| 5,396,763 A | | 3/1995 | Mayer et al. | |
| 5,440,874 A | * | 8/1995 | Charier et al. | 60/39.75 |
| 5,820,336 A | * | 10/1998 | Hashimoto | 415/115 |

FOREIGN PATENT DOCUMENTS

| | | |
|---|---|---|
| DE | 26 28 807 | 1/1977 |
| DE | 26 43 049 | 4/1977 |
| EP | 0 550 126 | 7/1993 |
| GB | 1 289 435 | 9/1972 |
| GB | 1605309 | 2/1989 |

* cited by examiner

*Primary Examiner*—Ninh Nguyen
(74) *Attorney, Agent, or Firm*—Staas & Halsey LLP

(57) ABSTRACT

The invention relates to a cast turbine blading unit, in particular a gas turbine guide vane, having an airfoil and a platform region. The platform region is formed by a hot gas platform at the hot gas end and by a load-carrying platform opposite to it. The load-carrying platform accepts the forces so that the hot gas platform can be of thin configuration. There are particularly low thermal stresses.

13 Claims, 2 Drawing Sheets

TURBINE BLADE

BACKGROUND OF THE INVENTION

The invention relates to a cast turbine blading unit having an airfoil and a platform region.

DESCRIPTION OF THE RELATED ART

An impingement cooling system for a gas turbine blading unit is known from DE 26 28 807 A1. The gas turbine blading unit is directed along a blading unit axis and has an airfoil and a platform region along the blading unit axis. In the platform region, a platform extends radially away from the airfoil and transverse to the blading unit axis. Such a platform forms part of a flow duct for a working fluid which flows through a gas turbine in which the turbine blading unit is installed. In a gas turbine, very high temperatures occur in this flow duct. Because of this, the surface of the platform subjected to the hot gas is subjected to severe thermal loading. In order to cool the platform, a perforated wall element is arranged in front of the surface of the platform facing away from the hot gas. Cooling air enters via the holes in the wall element and impinges on the surface of the platform facing away from the hot gas. Efficient impingement cooling is achieved by this means.

GB-PS 1 289 435 relates to guide elements, in particular gas turbine blading units, for gas flows. A guide element which is built up in laminar fashion and which can be cooled by transpiration cooling is arranged on a cast component. This construction cannot be applied to cast turbine blading units.

DE 26 43 049 A1 shows a cooling arrangement for cooling the platform of a turbine blading unit. As compared with the arrangement in DE 26 28 807 A1, mentioned above, a plate with openings is arranged in front of the surface of the platform facing away from the hot gas surface and cooling air flows through these openings towards the platform.

SUMMARY OF THE INVENTION

The object of the invention is to provide a cast turbine blading unit which can be subjected to high thermal loading and in which only small thermal stresses occur in the platform region. In accordance with the invention, this object is achieved by means of a cast turbine blading unit directed along a blading unit axis and having an airfoil and a platform region in sequence along the blading unit axis, the platform region comprising a hot gas platform extending transverse to the blading unit axis and bounding the airfoil and comprising a load-carrying platform opposite to the hot gas platform, the load-carrying platform being designed to accept forces which may be caused by a working fluid flowing around the airfoil.

A turbine blading unit is secured in the turbine, in particular on the turbine casing, by means of the platform region. In consequence, the platform must accept loads which are caused by forces acting on the airfoil. Such forces are caused by the pressure of the hot working fluid, for example a hot gas or steam, flowing through the turbine. The acceptance of these loads demands that the platform should have a minimum thickness so that it can transfer the forces to the turbine casing without deformation. At the same time, the platform as described above must bound the flow duct through which a hot gas flows. The invention pursues a new path in the design of the platform region for cast turbine blading units in that the platform region is configured as a double platform made up of two opposing platforms. This achieves the effect that the hot gas platform, which bounds the flow duct and is subjected to the hot gas, can be given a thin configuration. The configuration in two platforms provides a division of functions for the platforms. The hot gas platform is substantially responsible for bounding the flow duct and, therefore, for channeling the hot gas. The opposing load-carrying platform, which is not subjected to the hot gas, accepts the loads caused by the forces acting on the airfoil. This separation of functions makes it possible to provide the hot gas platform with such a thin configuration that the hot gas channeling is ensured without the need to accept substantial forces. The thin configuration of the hot gas platform gained in this manner provides the particular advantage that comparatively small thermal stresses arise in the hot gas platform. The configuration of the platform region as a double platform is also advantageous when compared with configurations in which a single-piece platform is reinforced by ribs on the surface facing away from the hot gas. This is because high thermal stresses can likewise occur at the transition locations between the ribs and the platform.

The hot gas platform is preferably substantially thinner than the load-carrying platform. Because the hot gas platform only has to accept, at most, a comparatively small part of the loads occurring, it can be provided with a thinner configuration than the load-carrying platform. The load-carrying platform accepts the major proportion of the forces occurring.

The airfoil is part of a profile section extending through the platform region, the hot gas platform and the load-carrying platform each having an inner edge by means of which they are connected to the profile section. In addition, they each have an outer edge by means of which they are connected to one another. It is also preferable for the hot gas platform and the load-carrying platform to be connected to one another only by means of their respective inner edges and their respective outer edges. This provides a small connecting surface between the hot gas platform and the load-carrying platform. Because of this small connecting surface and because of the connection via the respectively outer edges, only small thermal stresses occur in the double platform configuration for a high level of mechanical stability. Thermal expansions can take place relatively freely due to the small number of connection locations.

Guide elements for guiding a cooling medium to the hot gas platform are preferably arranged between the hot gas platform and the load-carrying platform. Such guide elements can, for example, be panels which sub-divide the space between the platforms in the manner of chambers or can also, for example, be ducts directed vertically between the platforms. By means of such guide elements, a cooling medium—in particular cooling air—can be efficiently directed against the surface of the hot gas platform facing away from the hot gas. This, in particular, permits efficient impingement cooling.

The guide elements are preferably configured with a wall thickness which is thin relative to the hot gas platform. Because of the thin configuration of the guide elements, no substantial additional thermal stresses are caused.

The load-carrying platform preferably has a plurality of through holes directed towards the hot gas platform. A cooling medium, in particular cooling air from a compressor of a gas turbine, can flow through the load-carrying platform and towards the hot gas platform, thus efficiently cooling the latter.

The turbine blading unit is preferably configured as a gas turbine blading unit, in particular for a stationary gas turbine.

The invention is described in more detail by means of the drawing. In this:

DETAILED DESCRIPTION OF THE INVENTION

Like designations have the same meaning in the individual figures.

Figure 1:
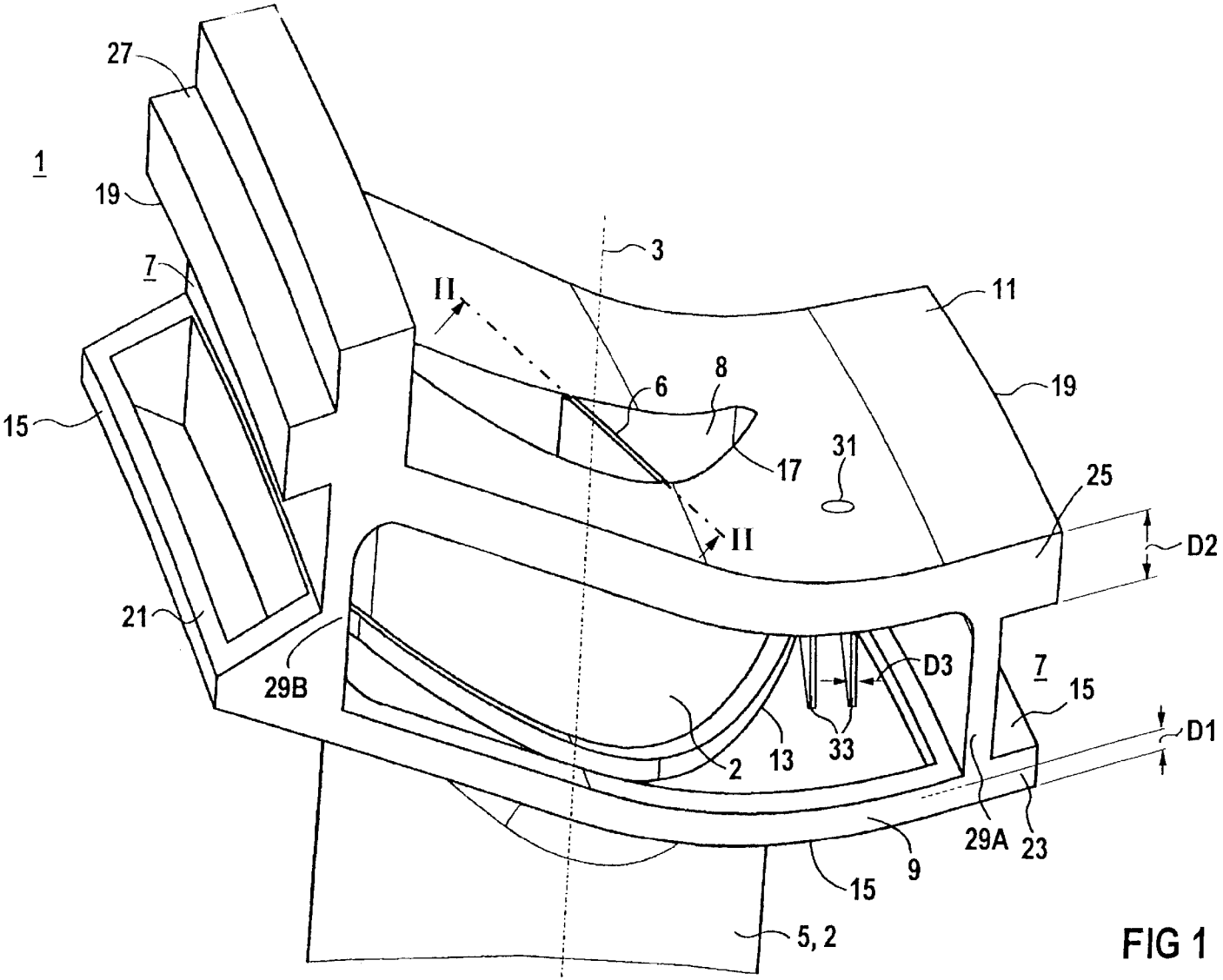
FIG. 1 shows a perspective representation of part of a gas turbine blading unit and FIG. 2 shows a longitudinal section through the gas turbine blading unit of FIG. 1.

FIG. 1 shows an excerpt from a cast gas turbine blading unit 1 directed along a blading unit axis 3 and having a profile section 2. Part of the profile section 2 forms an airfoil 5. A platform region 7 abuts the (only partially shown) airfoil 5 along the blading unit axis 3. The profile section 2 extends through the platform region 7. Within the profile section 2, the gas turbine blading unit 1 has a hollow space 8 extending as a through passage along the blading unit axis 3. A stiffening wall 6 extends through the hollow space 8 of the turbine blading unit 1 along the blading unit axis 3. A hot gas platform 9 associated with the platform region 7 and transverse to the blading unit axis 3 abuts the airfoil 5. A load-carrying platform 11 is located opposite to the hot gas platform 9. The hot gas platform 9 has an inner edge 13 by means of which it is connected to the profile section 2. The platform region 7 is integrally connected to the profile section 2 because the whole of the gas turbine blading unit 1 is a casting. The hot gas platform 9 also has an outer edge 15 which is approximately rectangular. The hot gas platform 9 is curved in the direction of the blading unit axis 3. Because of this shape of the hot gas platform 9, a flow duct which expands in the flow direction is produced when a plurality of similarly constructed turbine blading units are installed in a turbine.

The load-carrying platform 11 has an inner edge 17 which is likewise bounded by the profile section 2 and is simultaneously the edge of an opening of the hollow space 8 extending through the turbine blading unit 1. The load-carrying platform 11 likewise has an approximately rectangular outer edge 19 and has approximately the same curvature as the hot gas platform 9. The hot gas platform 9 has a thickness D1 and the load-carrying platform has a thickness D2. These thicknesses D1 and D2 can, if necessary, also vary within the respective platform, in which case average thicknesses are intended by the thicknesses D1 and D2. The load-carrying platform 11 and the hot gas platform 9 are connected to one another by means of their respective inner edges 13 and 17 and the profile section 2. In addition, the hot gas platform 9 and the load-carrying platform 11 are connected by a connecting element 29. The latter has a first part 29A arranged in the region of the outer edges 15 and 19. In addition, it has a second part 29B opposite to the first part 29A and likewise located in the region of the outer edges 15 and 19. The connecting element 29 bounds two opposite retention features 21 and 23 relative to the hot gas platform 9. A retention feature 25 is likewise bounded relative to the load-carrying platform 11. Opposite to the retention feature 25, the load-carrying platform 11 also has a step-type retention feature 27. The turbine blading unit 1 is held in a gas turbine (not shown) by means of these retention features 21, 23, 25 and 27. In this arrangement, a flow path through the gas. turbine is partially bounded by the hot gas surface 10 (see FIG. 2) of the hot gas platform 9. A hot working fluid flowing through the gas turbine flows around the airfoil 5. Strong forces on the airfoil 5 result from this and are transmitted via the platform region 7 to the gas turbine casing (not shown). The main part of this load is accepted by the load-carrying platform 11. Because of this, the hot gas platform 9 can have a thinner configuration than the load-carrying platform 11, i.e. the thickness D1 of the hot gas platform 9 is less than the thickness D2 of the load-carrying platform 11. In consequence, only comparatively small thermal stresses occur in the hot gas platform 9. The surface 12 facing away from the hot gas surface 10 (see FIG. 2) of the hot gas platform 9 can be cooled by a supply of cooling air. For this purpose, cooling air is fed through the load-carrying platform 11 via through holes 31 in the load-carrying platform 11—only one through hole 31 is shown as an example. Guide elements 33 guide the cooling air fed in this way onto the hot gas platform 9. This provides efficient impingement cooling of the hot gas platform 9.

Figure 2:
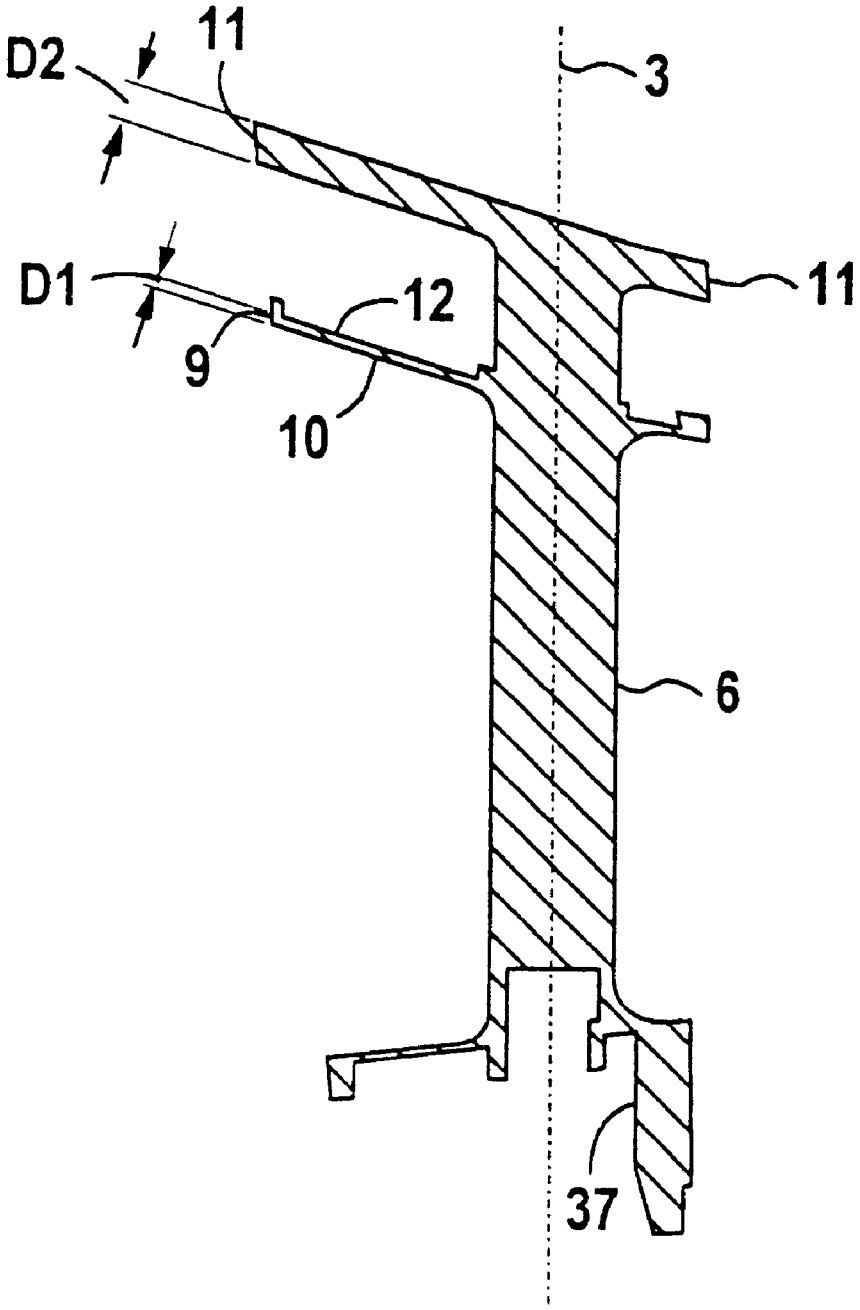

FIG. 2 shows a longitudinal section through the gas turbine blading unit 1 of FIG. 1. In this view, the stiffening wall 6 leading through the hollow space 8 of the turbine blading unit 1 is visible. It is clear from FIG. 2 that the hot gas platform 9 and the load-carrying platform 11 are independent of one another to a large extent. This achieves functional separation for the platforms 9 and 11. The hot gas platform 9 undertakes the channeling of the hot working fluid and only needs to accept, at most, a small part of the forces which are exerted by the working fluid on the airfoil 5. In consequence, the hot gas platform 9 can have a thin configuration. This provides the major advantage that only small thermal stresses occur in the hot gas platform 9. The load-carrying platform 11 has a thicker configuration because it accepts the major part of the forces. It is, however, protected by the hot gas platform 9 from the hot working fluid so that there are, again, hardly any thermal stresses in the load-carrying platform 11.

What is claimed is:

1. A cast turbine blading unit directed along a blading unit axis, comprising:

an airfoil; and a platform region following the airfoil in sequence along the blading unit axis and including a hot gas platform having an outer edge and extending transverse to the blading unit axis and bounding the airfoil, and a load-carrying platform, opposite to and thicker than the hot gas platform, to accept forces caused by a working fluid flowing around the airfoil, and having an outer edge connected to the outer edge of the hot gas platform.

2. The turbine blading unit as claimed in claim 1, wherein the airfoil is part of a profile section extending through the platform region, and wherein the hot gas platform and the load-carrying platform each have an inner edge by which they are connected to the profile section.

3. The turbine blading unit as claimed in claim 2, wherein the hot gas platform and the load-carrying platform each have an outer edge at which they are connected to one another.

4. The turbine blading unit as claimed in claim 2, wherein the hot gas platform and the load-carrying platform are only connected to one another by respective inner edges and respective outer edges.

5. The turbine blading unit as claimed in claim 4, further comprising guide elements arranged between the hot gas platform and the load-carrying platform to guide a cooling medium to the hot gas platform.

6. The turbine blading unit as claimed in claim 5, wherein the hot gas platform has a thickness, and wherein the guide elements are configured as walls with a wall thickness that is thin relative to the thickness of the hot gas platform.

7. The turbine blading unit as claimed in claim 6, wherein the load-carrying platform has a plurality of through holes directed towards the hot gas platform.

8. The turbine blading unit as claimed in claim 7, wherein the turbine blading unit is configured as a guide vane for a stationary gas turbine.

9. The turbine blading unit as claimed in claim 6, wherein the turbine blading unit is configured as a guide vane for a stationary gas turbine.

10. The turbine blading unit as claimed in claim 4, wherein the load-carrying platform has a plurality of through holes directed towards the hot gas platform.

11. The turbine blading unit as claimed in claim 1, further comprising guide elements arranged between the hot gas platform and the load-carrying platform to guide a cooling medium to the hot gas platform.

12. The turbine blading unit as claimed in claim 11, wherein the hot gas platform has a thickness, and wherein the guide elements are configured as walls with a wall thickness that is thin relative to the thickness of the hot gas platform.

13. The turbine blading unit as claimed in claim 1, wherein the airfoil is part of a profile section extending through the platform region, and wherein the hot gas platform and the load-carrying platform each have an inner edge by which they are connected to the profile section.

* * * * *